US010184662B2

(12) United States Patent
Yokota et al.

(10) Patent No.: US 10,184,662 B2
(45) Date of Patent: Jan. 22, 2019

(54) GAS TURBINE COMBUSTION LINER WITH TRIANGULAR HEAT TRANSFER ELEMENT

(71) Applicant: Mitsubishi Hitachi Power Systems, Ltd., Yokohama, Kanagawa (JP)

(72) Inventors: Osami Yokota, Yokohama (JP); Masataka Hidaka, Tokyo (JP); Shohei Numata, Yokohama (JP); Tetsuma Tatsumi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 543 days.

(21) Appl. No.: 14/531,253

(22) Filed: Nov. 3, 2014

(65) Prior Publication Data

US 2015/0121885 A1 May 7, 2015

(30) Foreign Application Priority Data

Nov. 5, 2013 (JP) ..... 2013-229514

(51) Int. Cl.
*F23R 3/06* (2006.01)
*F23R 3/00* (2006.01)
*F23R 3/54* (2006.01)

(52) U.S. Cl.
CPC ..... *F23R 3/06* (2013.01); *F23R 3/002* (2013.01); *F23R 3/005* (2013.01); *F23R 3/54* (2013.01);
(Continued)

(58) Field of Classification Search
CPC .... F23R 3/06; F23R 3/002; F23R 3/54; F23R 3/30; F23R 2900/03042;
(Continued)

(56) References Cited

U.S. PATENT DOCUMENTS 4,236,378 A 12/1980 Vogt
4,242,871 A * 1/1981 Breton ..... F23R 3/002 60/757
(Continued)

FOREIGN PATENT DOCUMENTS

EP 2 770 258 A2 8/2014
JP 57-142422 A 9/1982
(Continued)

OTHER PUBLICATIONS

European Search Report dated Apr. 2, 2015 (Six (6) pages).
(Continued)

*Primary Examiner* — Andrew Nguyen
*Assistant Examiner* — James McGlynn
(74) *Attorney, Agent, or Firm* — Crowell & Moring LLP

(57) ABSTRACT

A gas turbine combustor achieves improved product reliability and a reduced increase in pressure loss through improvements made on a cooling characteristic and structural intensity. The structure of the gas turbine combustor includes a plurality of circularity recesses formed on a side of an annular passage on a partial area of a combustion liner that requires cooling. Each of the circularity recesses has a rectangular surface forming a convex at a right angle with respect to a flowing direction of combustion air. The circularity recesses form a rectangular triangle having an oblique surface facing upstream of the flowing direction of the combustion air.

3 Claims, 5 Drawing Sheets

(52) U.S. Cl.
CPC ..... *F05D 2260/202* (2013.01); *F05D 2260/2212* (2013.01); *F05D 2260/2214* (2013.01); *F05D 2260/22141* (2013.01); *F23R 2900/03041* (2013.01); *F23R 2900/03042* (2013.01); *F23R 2900/03043* (2013.01); *F23R 2900/03045* (2013.01)

(58) Field of Classification Search
CPC .. F23R 2900/03045; F23R 2900/03041; F23R 2900/03043; F02K 1/78; F02K 1/80; F02K 1/82; F02K 1/822; F05D 2260/202; F05D 2260/2212; F05D 2260/2214; F05D 2260/22141
USPC ..... 60/754, 757, 752
See application file for complete search history.

(56) References Cited

U.S. PATENT DOCUMENTS 4,380,906 A 4/1983 Dierberger
4,622,821 A 11/1986 Madden
4,875,339 A * 10/1989 Rasmussen ..... F23R 3/06 60/757
4,916,906 A * 4/1990 Vogt ..... F01D 5/188 60/752
5,361,828 A * 11/1994 Lee ..... F01D 5/187 165/109.1
6,145,319 A * 11/2000 Burns ..... F23R 3/002 60/754
6,568,079 B2 * 5/2003 Farmer ..... B23P 6/005 29/402.03
7,926,278 B2 * 4/2011 Gerendas ..... F23R 3/002 60/725
2005/0050896 A1 3/2005 McMasters
2012/0047895 A1 3/2012 Sridhar et al.
2012/0272654 A1 * 11/2012 Kaleeswaran ..... F23R 3/002 60/772
2013/0047618 A1 * 2/2013 Gregory ..... F23R 3/002 60/722
2013/0074507 A1 * 3/2013 Kaleeswaran ..... F23R 3/002 60/754

FOREIGN PATENT DOCUMENTS

JP 8-254316 A 10/1996
JP 2001-280154 A 10/2001
JP 2005-98687 A 4/2005
JP 4134513 B2 8/2008
JP 2012-47173 A 3/2012

OTHER PUBLICATIONS

Japanese-language Office Action issued in counterpart Japanese Application No. 2013-229514 dated Aug. 1, 2017 (Three (3) pages).

* cited by examiner

GAS TURBINE COMBUSTION LINER WITH TRIANGULAR HEAT TRANSFER ELEMENT

BACKGROUND OF THE INVENTION

1. Field of the Invention

The present invention relates to a gas turbine combustor for heat-transfer enhancement.

2. Description of the Related Art

Various structures have been devised for heat-transfer enhancement between fluids and solids in, for example, cooling, heating, and heat exchange in combustion liners, turbine blades, heat-exchange equipment, fins, steam boilers, and furnaces of gas turbines based on specifications required for each of these devices.

The combustor in a power generation gas turbine, for example, is required to maintain a required level of cooling performance with pressure loss as small as not to impair gas turbine efficiency and to maintain reliability in structural intensity. The combustor is also required to reduce the amount of nitrogen oxide (NOx) emissions produced therein in order to respond to environmental issues. The reduction in the amount of NOx emissions has been achieved by using premixed combustion whereby fuel and air are mixed with each other before combustion and the fuel-air mixture is burned at a fuel-air ratio lower than the stoichiometric mixture ratio.

As background of the invention, Japanese Patent No. 4134513 discloses a technique relating to a gas turbine combustor structure intended to address the foregoing problems, the technique pertaining to a device for improving intensity by forming an annular rib on an outer peripheral side of a liner. A cylindrical member and the annular rib in the liner are welded or brazed together at their areas of contact.

SUMMARY OF THE INVENTION

In forced convection heat transfer, it is necessary to minimize an increase in pressure loss relative to heat-transfer enhancement in order to improve efficiency. For example, the combustion gas temperature needs to be increased for improving efficiency of a gas turbine, which, in turn, requires enhancement of liner cooling. The increase in the pressure loss should, however, be avoided in a method for further enhancing cooling.

Against this background, the known structure (rib) is disposed annularly on the outer peripheral side of the liner, thereby offering both improved intensity and cooling performance. The technique disclosed in Japanese Patent No. 4134513 is more advantageous in terms of structural intensity, cooling performance, and flame holding performance as compared with those developed therebefore.

In the technique disclosed in Japanese Patent No. 4134513, however, the structure (rib) is disposed on a face of the combustion liner on which temperatures are high and this basic arrangement involves a portion at which the liner and the structure overlap with each other. A tremendous amount of cost and time is thus required for providing a method of cooling the high-temperature zone and devising a structure therefor, and in particular, for achieving product reliability in terms of heat intensity.

The present invention has been made in view of the foregoing situation and it is an object of the present invention to provide a gas turbine combustor that improves product reliability and prevents pressure loss from increasing with its improved cooling characteristic and structural intensity.

To solve the foregoing problem, the arrangements as defined in the appended claims are exemplarily incorporated.

The present invention includes a plurality of means for solving the above-described problem. In one aspect, for example, the present invention provides a gas turbine combustor including: a combustion liner; an outer casing disposed on an outer peripheral side of the combustion liner; and an annular passage, formed between the combustion liner and the outer casing, configured to allow a heat-transfer medium to flow therethrough, wherein the combustion liner has a circularity recess on a side of the annular passage, the circularity recess having a surface forming a convex at a right angle with respect to a flowing direction of the heat-transfer medium.

The present invention achieves improved product reliability and a reduced increase in pressure loss through improvements made on a cooling characteristic and structural intensity.

BRIEF DESCRIPTION OF THE DRAWINGS

The present invention will be described hereinafter with reference to the accompanying drawings.

DESCRIPTION OF THE PREFERRED EMBODIMENTS

Gas turbine combustors according to preferred embodiments of the present invention will be described below with reference to the accompanying drawings.

First Embodiment

A gas turbine combustor according to a first embodiment of the present invention will be described with reference to FIGS. 1 to 3.

Figure 1:
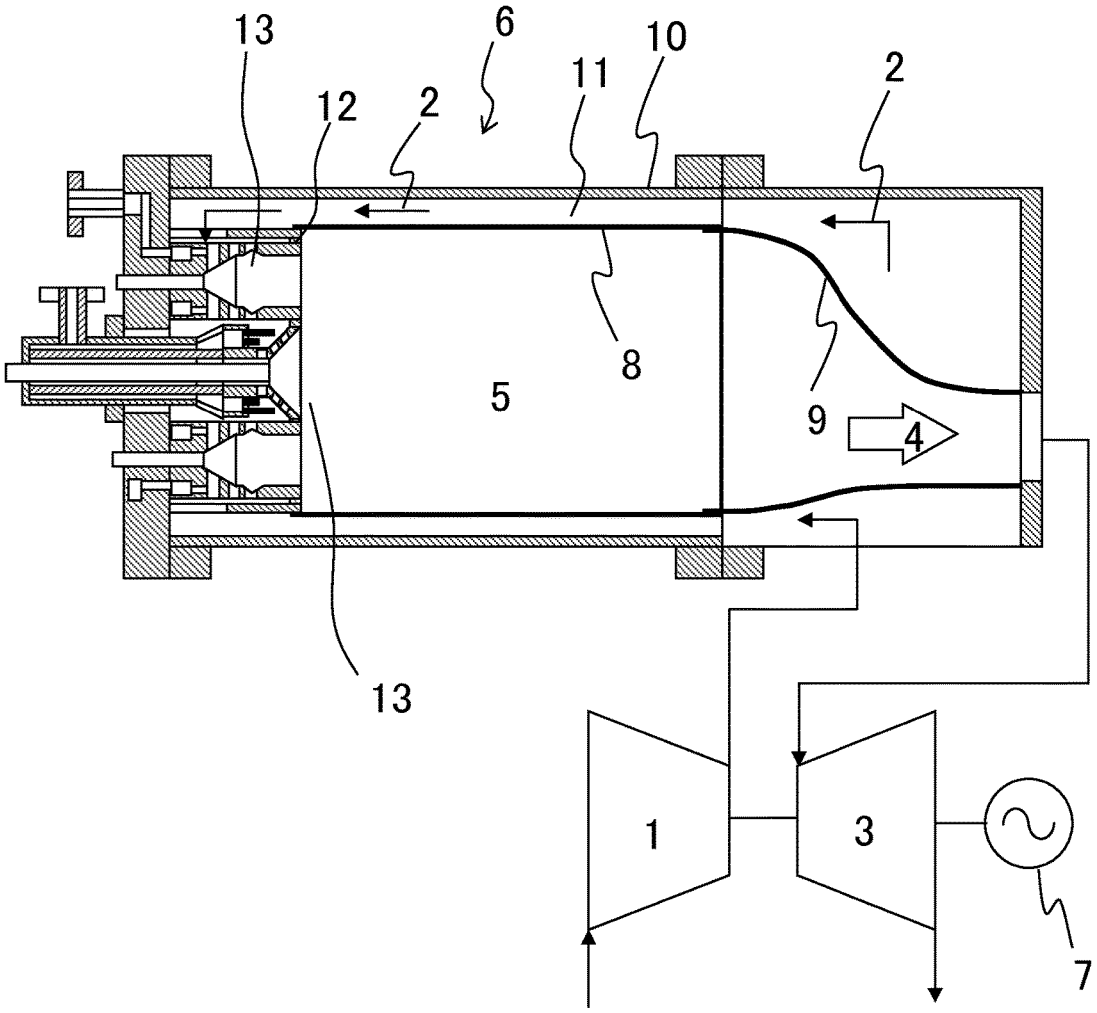
FIG. 1 is a schematic configuration diagram showing a gas turbine combustor according to a first embodiment of the present invention and a gas turbine plant including the same.

FIG. 1 is a schematic configuration diagram showing a gas turbine combustor according to the first embodiment of the present invention and a gas turbine plant including the same. FIG. 2 is a configuration diagram showing an example of a heat-transfer enhancement type gas turbine combustor for including a combustion liner that has a circularity recess in a rectangular triangle shape forming a convex on an outer peripheral side of a partial area thereof. FIG. 3 is a partial enlarged view of the heat-transfer enhancement type combustion liner having the circularity recess in a rectangular triangle shape serving as a convex on the outer peripheral side of a partial area thereof.

As shown in FIG. 1, the gas turbine plant (a gas turbine power generation facility) generally includes a compressor 1, a combustor 6, a turbine 3, and a generator 7.

The compressor 1 compresses air to thereby produce combustion air (compressed air) at high pressure. The turbine 3 acquires an axial driving force from energy of combustion gas 4 produced by the combustor 6. The generator 7 is driven by the turbine 3 to generate electric power.

The compressor 1, the turbine 3, and the generator 7 shown in the figure each have a rotational shaft connected mechanically to each other.

The combustor 6 mixes combustion air 2 introduced from the compressor 1 with fuel and burns a resultant mixture to thereby generate the combustion gas 4 at high temperature. The combustor 6 includes an outer casing 10, a combustion liner (inner casing) 8, a transition piece 9, an annular passage 11, a plate 12, and a plurality of burners 13.

The combustion liner 8 is a cylindrical liner disposed inside, and spaced apart from, the outer casing 10 and forming a combustion chamber 5 thereinside. The transition piece 9 is a structure connected to an opening in the combustion liner 8 on the side of the turbine 3 and introducing the combustion gas 4 produced in the combustion chamber 5 to the turbine 3. The outer casing 10 is a cylindrical structure disposed on the outer peripheral side of, and concentrically with, the combustion liner 8, the outer casing 10 regulating a flow rate of, and drift in, air supplied to the combustor 6. The annular passage 11 is formed between the outer casing 10 and the combustion liner 8, serving as a passage through which the combustion air (a heat-transfer medium) 2 supplied from the compressor 1 is passed. The plate 12 is a substantially disc-shaped member disposed substantially orthogonal to a central axis of the combustion liner 8 so as to totally close an upstream side end portion of the combustion liner 8 in combustion gas flowing direction and to have a first side end face facing the combustion chamber 5. The burners 13 are disposed on the plate 12 and jet fuel to the combustion chamber 5.

In the combustor 6 having the arrangements as described above, the combustion air 2 supplied from the compressor 1 serves, when flowing through the annular passage 11 between the combustion liner 8 and the outer casing 10, as convection cooling fluid for the combustion liner 8. The combustion air 2 is thereafter supplied to the burners 13 for use as air for combustion.

Figure 2:
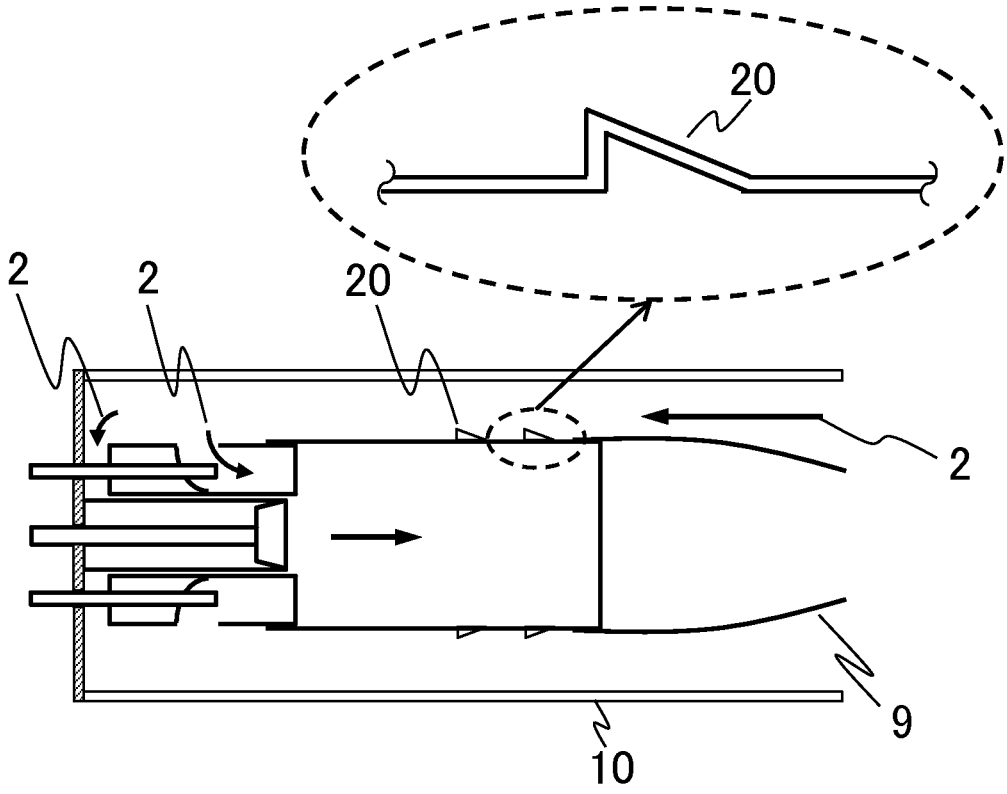
FIG. 2 is a schematic configuration diagram showing an example of a heat-transfer enhancement type liner incorporated in the gas turbine combustor according to the first embodiment of the present invention.
Figure 3:
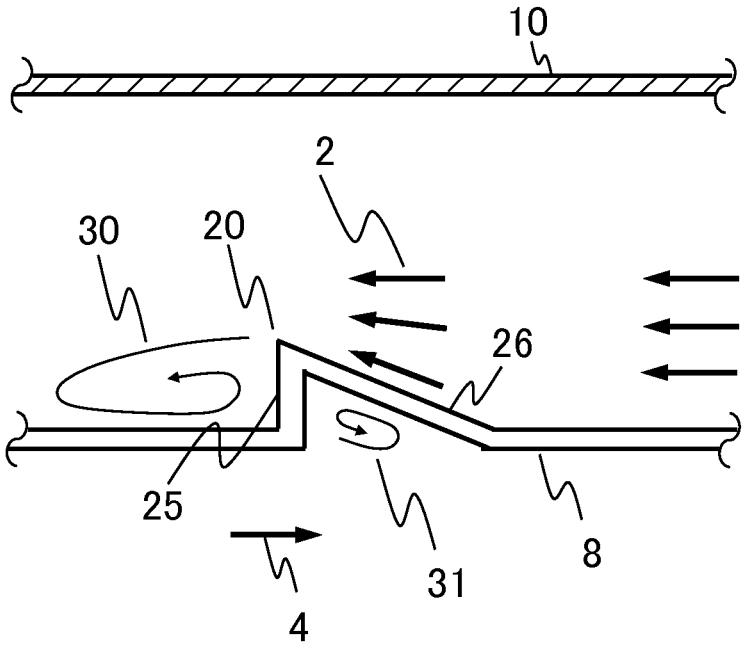
FIG. 3 is a partial enlarged view of the heat-transfer enhancement type liner incorporated in the gas turbine combustor according to the first embodiment of the present invention shown in FIG. 2.

As shown in FIGS. 2 and 3, the combustion liner 8 has a plurality of circularity recesses 20 formed on a partial area of the combustion liner 8 requiring cooling on the side of the annular passage 11. The circularity recesses 20 each have a rectangular surface 25 forming a convex at a right angle with respect to the flowing direction of the combustion air 2. In FIG. 2, the circularity recess 20 is a rectangular triangle having an oblique surface 26 and the rectangular surface 25, the oblique surface 26 facing upstream of the flowing direction of the combustion air 2 and the rectangular surface 25 facing downstream of the flowing direction of the combustion air 2.

The following describes with reference to FIG. 3 specific heat transfer actions achieved by the circularity recesses 20 in a rectangular triangle shape.

As shown in FIG. 3, when the combustion air 2 flows through the annular passage 11 between the combustion liner 8 and the outer casing 10 to reach the circularity recess 20 having the oblique surface 26, the combustion air 2 on the outer surface of the circularity recess 20 contracts, resulting in accelerated flow velocity. A heat transfer characteristic is generally known such that the higher the flow velocity of the combustion air 2, the greater a heat transfer rate, resulting in an improved heat transfer effect. The increase in the flow velocity of the combustion air 2 on the face of the oblique surface 26 of the circularity recess 20 improves the heat transfer characteristic, resulting in an improved cooling characteristic. A circularity concave portion (formed as a result of the circularity recess 20 being formed) is formed on the inner peripheral side of the combustion liner 8 through which the combustion gas 4 as a heating medium flows. Part of the combustion gas 4 flows into this circularity concave portion. This forms a circulating flow 31 in the circularity concave portion. The circulating flow 31, while having a high temperature, is slow in velocity, so that the heat transfer rate to the circularity recess 20 is low and the heat transfer characteristic is reduced accordingly. Thus, cooling performance is generally improved in the portion of the circularity recess 20, because the amount of heat transferred from the circulating flow 31 as the heating medium is small at the concave portion of the circularity recess 20 on the inner peripheral side of the combustion liner 8 and, in contrast, the heat transfer characteristic is improved at the convex portion of the circularity recess 20 on the outer peripheral side of the combustion liner 8.

A separation vortex 30 is generated downstream of the circularity recess 20 on the outer peripheral side of the combustion liner 8. The separation vortex 30 destroys a boundary layer of the combustion air 2 produced in an area downstream of the circularity recess 20 near a wall surface of the combustion liner 8, achieving a cooling promoting effect on the face of the combustion liner 8. In addition, the shape of the rectangular portion that forms part of the circularity recess 20 having the convex portion in a rectangular triangle shape offers a structural characteristic identical to that achieved by an L-shaped annular rib. This structural characteristic improves stiffness and an effect from the improved intensity prevents damage from, for example, vibration.

Another effect achieved by the heat-transfer enhancement type liner structure, in addition to the effects of the improved cooling performance and intensity, is reduction in pressure loss. Specifically, in the known structure having the annular rib intended for improving intensity of the combustion liner on the outer circumference of the combustion liner, a phenomenon of a suddenly contracted flow of the combustion air 2 is a cause for increased pressure loss. In contrast, in the first embodiment of the present invention, the triangular shape produces a smooth contracted flow, which expectedly leads to a reduction in the pressure loss.

As described above, the gas turbine combustor according to the first embodiment of the present invention includes the combustion liner 8 having the circularity recesses 20 formed on a partial area of the combustion liner 8 on the side of the annular passage 11, the circularity recesses 20 each having the rectangular surface 25 that serves as a convex on the outer peripheral side of the combustion liner 8 and thus having a cross section in a rectangular triangle shape. This arrangement can improve both the cooling performance and the intensity. The arrangement also eliminates the need for the L-shaped rib welded to the outer peripheral side of the combustion liner 8. In the arrangement in the first embodiment, because of no portions of metal plates overlapping with each other as in the related-art arrangement, reliability of the combustion liner can be enhanced and a longer service life of the combustion liner can be promoted. In addition, the circularity recess 20, because having the oblique surface 26, can prevent the pressure loss from increasing, while allowing the combustion air 2 to flow along the surface of a member to thereby achieve heat exchange between the member and the combustion air 2. Thus, reliability in the structural intensity can be improved, while a required level of cooling performance is maintained with pressure loss as small as not to impair gas turbine efficiency. The premixed combustion air is increased to keep the fuel air ratio low and a local flame temperature is reduced to achieve low NOx emissions.

Second Embodiment

A gas turbine combustor according to a second embodiment of the present invention will be described with reference to FIG. 4.

The gas turbine combustor according to the second embodiment is configured substantially identically to the gas turbine combustor according to the first embodiment except for the circularity recess and detailed descriptions for the identical portions will be omitted.

Figure 4:
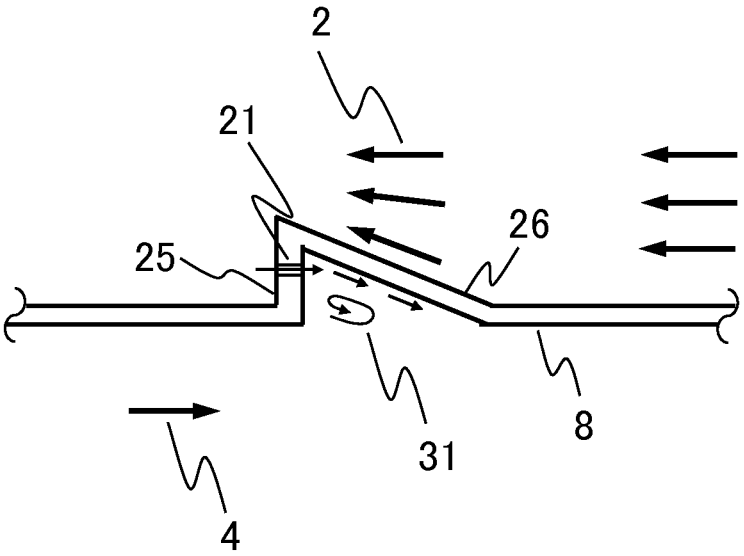
FIG. 4 is a schematic configuration diagram showing an example of a heat-transfer enhancement type liner incorporated in a gas turbine combustor according to a second embodiment of the present invention.

FIG. 4 shows a configuration of a heat-transfer enhancement type combustion liner incorporated in the gas turbine combustor according to the second embodiment of the present invention.

As shown in FIG. 4, the gas turbine combustor according to the second embodiment includes a combustion liner 8 having a circularity recess 20 in a rectangular triangle shape formed on a partial area on the outer peripheral side of the combustion liner 8, the circularity recess 20 assuming a convex portion. The circularity recess 20 has a rectangular surface 25 downstream of the flowing direction of combustion air 2. The rectangular surface 25 has a plurality of holes of jet flow 21 arranged in a circumferential direction of the circularity recess 20, the holes of jet flow 21 each having a central axis extending in parallel with a central axis of the combustion liner 8. It is noted that, for convenience sake, FIG. 4 shows only one hole of jet flow 21.

The gas turbine combustor according to the second embodiment of the present invention can also achieve effects substantially identical to those achieved by the gas turbine combustor according to the first embodiment described earlier.

Additionally, the combustion air 2 flowing through the holes of jet flow 21 forms an air layer on an inner peripheral surface of the circularity recess 20. The air layer further improves the cooling effect. Specifically, the combustion air 2 that flows through the holes of jet flow 21 forms the air layer between a wall surface on the inner peripheral side of the circularity recess 20 and a circulating flow 31 at high temperature. This eliminates likelihood that the circulating flow 31 at high temperature will directly contact the wall surface on the inner peripheral side of the circularity recess 20, so that a greater cooling effect can be achieved at the circularity recess 20.

Third Embodiment

A gas turbine combustor according to a third embodiment of the present invention will be described with reference to FIGS. 5 and 6.

The gas turbine combustor according to the third embodiment is configured substantially identically to the gas turbine combustor according to the first embodiment except for the circularity recess and detailed descriptions for the identical portions will be omitted.

Figure 5:
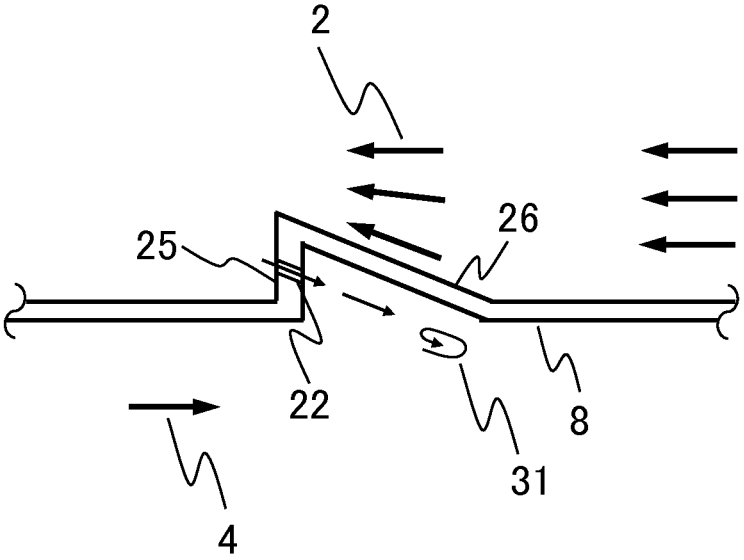
FIG. 5 is a schematic configuration diagram showing an example of a heat-transfer enhancement type liner incorporated in a gas turbine combustor according to a third embodiment of the present invention.

FIG. 5 shows a configuration of a heat-transfer enhancement type combustion liner incorporated in the gas turbine combustor according to the third embodiment of the present invention. FIG. 6 is a configuration of another heat-transfer enhancement type combustion liner incorporated in the gas turbine combustor according to the third embodiment of the present invention.

As shown in FIG. 5, the gas turbine combustor according to the third embodiment includes a combustion liner 8 having a circularity recess 20 in a rectangular triangle shape formed on a partial area on the outer peripheral side of the combustion liner 8, the circularity recess 20 assuming a convex portion. The circularity recess 20 has a rectangular surface 25 downstream of the flowing direction of combustion air 2. The rectangular surface 25 has a plurality of holes of jet flow 22 arranged in a circumferential direction of the circularity recess 20, the holes of jet flow 22 each having a central axis inclined with respect to a central axis of the combustion liner 8.

The gas turbine combustor according to the third embodiment of the present invention can also achieve effects substantially identical to those achieved by the gas turbine combustor according to the first embodiment described earlier.

Additionally, the combustion air 2 flowing through the inclined holes of jet flow 22 further improves the cooling effect on the inner peripheral surface of the circularity recess 20. Specifically, an action by the combustion air 2 flowing through the inclined holes of jet flow 22 to push out or destroy a circulating flow 31 produced in a concave portion on the inner peripheral side of the circularity recess 20 supplies the combustion air 2 at low temperature to the concave portion side at all times. This achieves an even greater cooling effect in the circularity recess 20.

Figure 6:
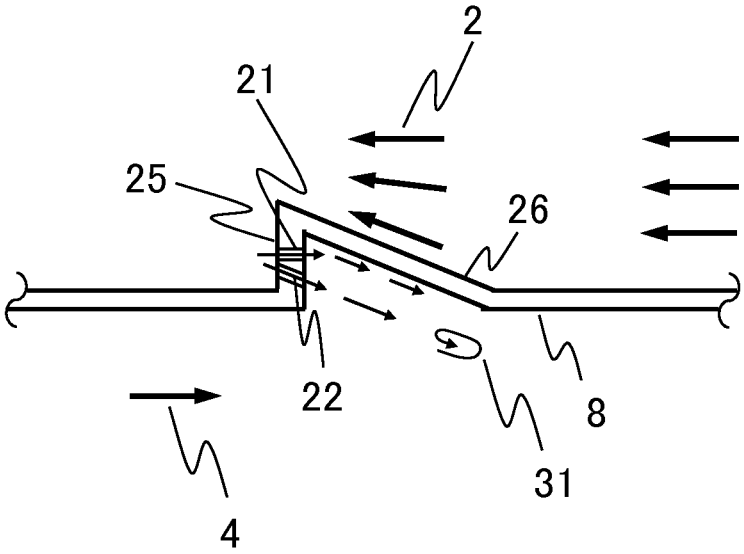
FIG. 6 is a schematic configuration diagram showing another example of a heat-transfer enhancement type liner incorporated in the gas turbine combustor according to the third embodiment of the present invention.

It is noted that, as shown in FIG. 6, the rectangular surface 25 of the circularity recess 20 may have both the holes of jet flow 21, each having a central axis extending in parallel with the central axis of the combustion liner 8, and the holes of jet flow 22, each having a central axis inclined with respect to the central axis of the combustion liner 8.

Fourth Embodiment

A gas turbine combustor according to a fourth embodiment of the present invention will be described with reference to FIG. 7.

The gas turbine combustor according to the fourth embodiment is configured substantially identically to the gas turbine combustor according to the first embodiment except for the circularity recess and its surrounding parts, and detailed descriptions for the identical portions will be omitted.

Figure 7:
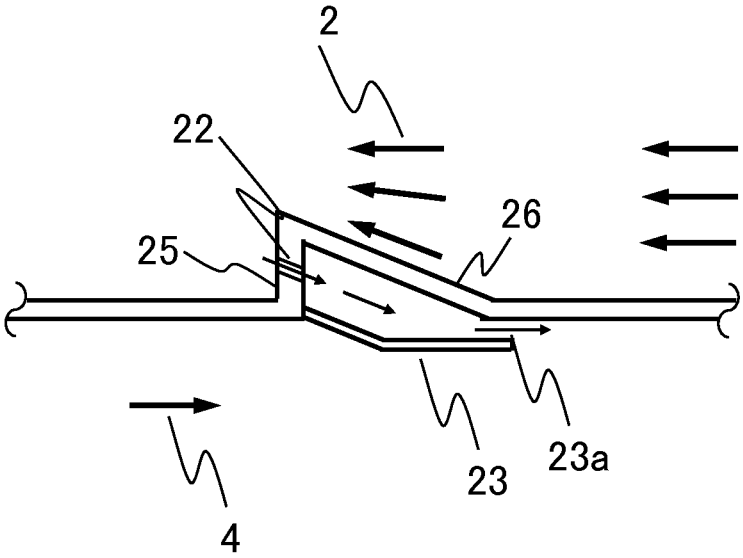
FIG. 7 is a schematic configuration diagram showing an example of a heat-transfer enhancement type liner incorporated in a gas turbine combustor according to a fourth embodiment of the present invention.

FIG. 7 shows a configuration of a heat-transfer enhancement type combustion liner incorporated in the gas turbine combustor according to the fourth embodiment of the present invention.

As shown in FIG. 7, the gas turbine combustor according to the fourth embodiment includes an inclined plane 23 disposed at the circularity concave portion formed on the inner peripheral side of the combustion liner 8 through which the heating medium flows. The inclined plane 23 results in a circularity slit 23*a* being formed. In addition, the rectangular surface 25 of the circularity recess 20 has a plurality of holes of jet flow 22 arranged in the circumferential direction of the circularity recess 20, the holes of jet flow 22 each having a central axis inclined with respect to the central axis of the combustion liner 8.

The gas turbine combustor according to the fourth embodiment of the present invention can also achieve effects substantially identical to those achieved by the gas turbine combustor according to the first embodiment described earlier.

The combustion air 2 flows through the inclined holes of jet flow 22 formed in the rectangular surface 25 of the circularity recess 20 into a space formed by the circularity concave portion and the slit 23*a* on the inner peripheral side of the combustion liner 8. This combustion air 2 cools the circularity recess 20 generally. Furthermore, air discharged from an opening in the slit 23*a* is formed into a film. A heat insulating action by the formation of the air film achieves an effect of protecting the combustion liner 8 from the high-temperature combustion gas 4 as the heating medium.

The fourth embodiment has been described for a configuration in which the rectangular surface 25 of the circularity recess 20 has the holes of jet flow 22, each having a central axis inclined with respect to the central axis of the combustion liner 8. This is, however, not the only possible arrangement. Alternatively, the rectangular surface 25 may have a plurality of holes of jet flow 21, each having a central axis extending in parallel with the central axis of the combustion liner 8.

Fifth Embodiment

A gas turbine combustor according to a fifth embodiment of the present invention will be described with reference to FIG. 8.

The gas turbine combustor according to the fifth embodiment is configured substantially identically to the gas turbine combustor according to the first embodiment except for the circularity recess and detailed descriptions for the identical portions will be omitted.

Figure 8:
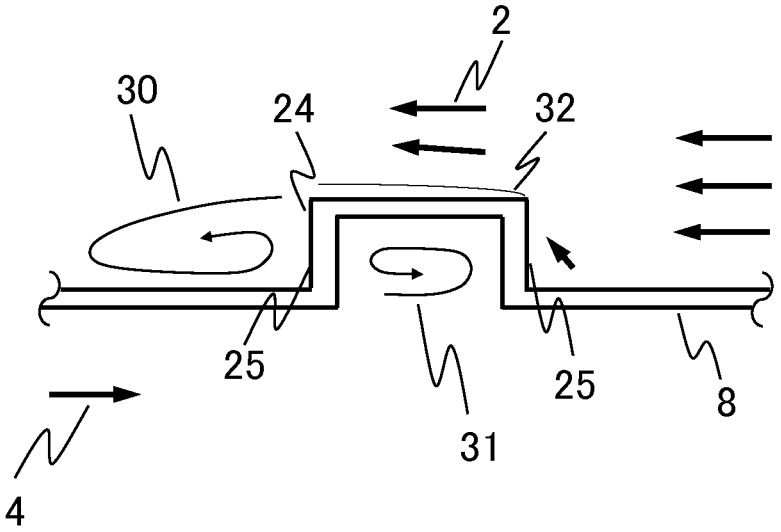
FIG. 8 is a schematic configuration diagram showing an example of a heat-transfer enhancement type liner incorporated in a gas turbine combustor according to a fifth embodiment of the present invention.

FIG. 8 shows a configuration of a heat-transfer enhancement type combustion liner incorporated in the gas turbine combustor according to the fifth embodiment of the present invention.

As shown in FIG. 8, the gas turbine combustor according to the fifth embodiment includes a combustion liner 8 having a rectangular circularity recess 24 formed on part of the combustion liner 8 and protruding from the outer peripheral surface of the combustion liner 8. The circularity recess 24 has a surface extending in parallel with the face of the combustion liner 8, the surface having a length longer than that of rectangular surfaces 25.

In the gas turbine combustor according to the fifth embodiment of the present invention, part of combustion gas 4 flows into the circularity concave portion formed on the inner peripheral side of the combustion liner 8, which forms a circulating flow 31. This circulating flow 31 has a high temperature, but is slow in velocity, so that only a small amount of heat is transferred to the circularity recess 24. Meanwhile, at the circularity recess 24 on the outer peripheral side of the combustion liner 8, a boundary layer 32 of combustion air 2 is newly formed at a leading end corner of the rectangular surface 25 disposed upstream of the combustion air 2, the boundary layer 32 starting with the leading end corner of the rectangular surface 25. This boundary layer 32 of the combustion air 2 is extremely thin in the beginnings of its formation, exhibiting a tendency toward a better heat transfer characteristic. The layer thickness increases as the combustion air 2 moves toward the downstream side, resulting in a gradually degraded heat transfer characteristic. As such, with the circularity recess 24 of the fifth embodiment, the amount of heat transferred from the circulating flow 31 as the heating medium is small at the circularity concave portion on the inner peripheral side of the combustion liner 8, but in contrast, the heat transfer characteristic improves at the convex portion of the circularity recess 24 protrusion on the outer peripheral side of the combustion liner 8. As a result, the cooling performance is generally improved.

Additionally, the shape of the rectangular surfaces 25 that constitute the rectangular convex portion of the circularity recess 24 has a structural characteristic identical to that achieved by the L-shaped annular rib as in the related art. In addition, the two rectangular surfaces 25 in the cross section of the circularity recess 24 further enhance stiffness, so that an effect of preventing damage by, for example, vibration can be further enhanced.

Sixth Embodiment

A gas turbine combustor according to a sixth embodiment of the present invention will be described with reference to FIG. 9.

The gas turbine combustor according to the sixth embodiment is configured substantially identically to the gas turbine combustor according to the first embodiment except for the circularity recess and detailed descriptions for the identical portions will be omitted.

Figure 9:
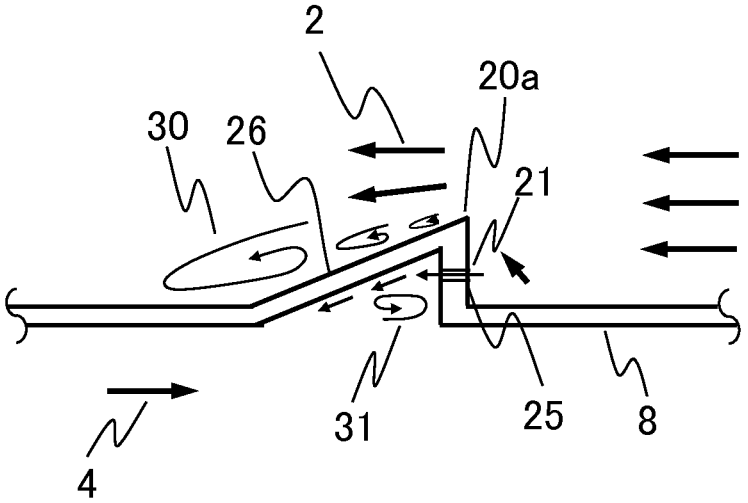
FIG. 9 is a schematic configuration diagram showing an example of a heat-transfer enhancement type liner incorporated in a gas turbine combustor according to a sixth embodiment of the present invention.

FIG. 9 shows a configuration of a heat-transfer enhancement type combustion liner incorporated in the gas turbine combustor according to the sixth embodiment of the present invention.

As shown in FIG. 9, the gas turbine combustor according to the sixth embodiment includes a combustion liner 8 having a circularity recess 20*a* formed on a partial area on the outer peripheral side of the combustion liner 8, the circularity recess 20*a* having a cross section in a rectangular triangle shape serving as a convex on the outer peripheral side of the combustion liner 8. The circularity recess 20*a* has a rectangular surface 25 that faces upstream in the flowing direction of combustion air 2 and an oblique surface 26 that faces downstream in the flowing direction of the combustion air 2. In addition, the rectangular surface 25 has a plurality of holes of jet flow 21 arranged in a circumferential direction of the circularity recess 20*a*, the holes of jet flow 21 each having a central axis extending in parallel with the central axis of the combustion liner 8.

The gas turbine combustor according to the sixth embodiment of the present invention can also achieve effects substantially identical to those achieved by the gas turbine combustor according to the first embodiment described earlier.

Additionally, static pressure of the combustion air 2 is recovered in an area near the rectangular surface 25 of the circularity recess 20*a*. A greater amount of the combustion air 2 corresponding to the recovery flows into from the holes of jet flow 21. A strong air layer is, as a result, formed between the wall surface on the inner peripheral side of the circularity recess 20*a* and a circulating flow 31 at high temperature. This eliminates likelihood that the circulating flow 31 at high temperature will directly contact the wall surface on the inner peripheral side of the circularity recess 20*a*, so that a greater cooling effect can be achieved at the circularity recess 20*a*.

Miscellaneous

The present invention is not limited to the described embodiments, and various modifications and variations are possible. The foregoing embodiments are those described in detail to explain the present invention clearly and the invention is not necessarily limited to those including all components described.

For example, preferably, the circularity recesses 20, 20*a*, and 24 are each integrally formed with the combustion liner 8.

What is claimed is:

1. A gas turbine combustor comprising:

a combustion liner configured to form a combustion chamber thereinside;

an outer casing disposed on an outer peripheral side of the combustion liner; and an annular passage, formed between the combustion liner and the outer casing, configured to allow a heat-transfer medium to flow therethrough, wherein the combustion liner has a circularity recess on a side of the annular passage, the circularity recess having a cross section in a rectangular triangle shape along a flowing direction of the heat transfer medium, the flowing direction of the heat transfer medium being substantially parallel to a central axis of the combustion liner, a surface at a right angle with respect to the flowing direction of the heat-transfer medium, and an oblique surface inclined with respect to the flowing direction of the heat transfer medium, the surface at the right angle and the oblique surface forming a convex, wherein the surface at the right angle and the oblique surface form edges of the rectangular triangle shape;

a connection point between the surface at the right angle and the oblique surface forms an edge of the combustion liner, the circularity recess forms a concavity, on an inner peripheral surface of the combustion liner exposed to a combustion gas, as seen from the combustion chamber, and the oblique surface faces upstream of the flowing direction of the heat-transfer medium and the surface at the right angle faces downstream of the flowing direction of the heat-transfer medium.

2. The gas turbine combustor according to claim 1, wherein the circularity recess has a plurality of holes of jet flow formed in the surface at the right angle thereof, each of the plurality of holes of jet flow having a central axis extending in parallel with the central axis of the combustion liner.

3. The gas turbine combustor according to claim 1, wherein the circularity recess has a plurality of holes of jet flow formed in the surface at the right angle thereof, each of the plurality of holes of jet flow having a central axis inclined with respect to the central axis of the combustion liner.

* * * * *